United States Patent [19]

Heinrich

[11] Patent Number: 4,893,423

[45] Date of Patent: Jan. 16, 1990

[54] TENSIONING SYSTEM FOR QUILT FRAMES

[76] Inventor: John T. Heinrich, 5 Mt. Shasta Ct., San Rafael, Calif. 94903

[21] Appl. No.: 241,892

[22] Filed: Sep. 6, 1988

[51] Int. Cl.[4] ..... D06C 3/08

[52] U.S. Cl. ..... 38/102.1; 226/91

[58] Field of Search ..... 38/102.1, 102.4, 102.5, 38/102.91; 226/91; 160/375, 378, 380

[56] References Cited

U.S. PATENT DOCUMENTS

| | | | |
|---|---|---|---|
| 1,299,873 | 4/1919 | Trueb | 38/102.4 |
| 2,037,991 | 4/1936 | Mavity | 38/102.91 |
| 3,098,280 | 7/1963 | Harris et al. | 38/102.91 X |
| 3,774,326 | 11/1973 | Selden | 38/102.4 |
| 4,043,270 | 8/1977 | Miner et al. | 38/102.91 |
| 4,614,049 | 9/1986 | Riley et al. | 38/102.91 |

FOREIGN PATENT DOCUMENTS

| | | | |
|---|---|---|---|
| 266240 | 2/1927 | United Kingdom | 38/102.91 |

*Primary Examiner*—Andrew M. Falik
*Attorney, Agent, or Firm*—Larry D. Johnson

[57] ABSTRACT

A quilting frame comprises a support structure, and a plurality of horizontal, elongate rollers to hold the desired quilting materials. These rollers terminate in shafts, which are captured in grooves formed between the block and cap portions of a split side rail. The block and cap of these rails are fastened together by a plurality of adjustable clamping bolts, preferably one adjacent each roller, so that pressure between the block and cap frictionally engages the roller shafts captured therebetween, and thus can be selected to lock or unlock the rollers within the rail. Also incorporated into this rail system is a lateral tension cord system comprising a small tension block conditioned for placement against the quilting material suspended between a pair of rollers, with at least one tension cord extending laterally from the block through a groove in the rail block. The quilting material is connected (e.g., by pins) to the tension block via a short fabric leader, and the tension cord pulled through the groove to the degree of desired lateral tension, where it is held by tightening of a clamping screw or other fastener.

3 Claims, 4 Drawing Sheets

TENSIONING SYSTEM FOR QUILT FRAMES

BACKGROUND OF THE INVENTION

1. Field of the Invention

This invention relates generally to frames, braces, and miscellaneous support structures, and more specifically to an improved frame for use with quilting and related handiwork.

2. Description of the Prior Art

Quilting has been, and continues to be, a popular activity. Most quilting is performed on frame structures used to support the quilting materials (e.g., the backing, batting, and quilt top) while the user is stitching them together. Typically, these frames include horizontal, elongate rollers suspended between a pair of side rails to hold the individual quilting materials before and during stitching, as well as the completed quilt after stitching.

Unfortunately, this basic design has numerous shortcomings. For example, the rollers by themselves are free-wheeling, and cannot maintain fore-and-aft tension on the quilting materials. Some frame manufacturers have addressed this problem by placement of threaded bolts with wingnuts or other tightening mechanisms through the side rails and into the respective rollers. However, this arrangement is unsatisfactory in that the wingnuts can be difficult to tighten and untighten, and tend to work themselves loose and unscrew under tension. Other manufacturers have incorporated a ratchet mechanism on one or more of the rollers to lock the rollers at a desired degree of tension. This, too, is not entirely helpful in that the ratchet mechanism does not typically enable fine (infinite) tension adjustment.

In addition, traditional quilting frames do not provide any means for applying lateral (side-to-side) tension on the quilting materials. Thus, while tension can be crudely applied fore-and-aft by the above mechanisms, there is no equivalent means for lateral tension.

Still further, initial placement of the quilting materials onto the rollers of known quilting frames is an imprecise process. The user must estimate the proper centering and alignment of the materials to the rollers, which of course is prone to human error.

SUMMARY OF THE INVENTION

The quilting frame of this invention provides an improved quilting frame enabling complete fore-and-aft and lateral tension adjustment to the quilting materials, as well as an improved alignment system for initial installation of the quilting materials on the frame. The improved frame comprises a more or less standard support structure, and a plurality of horizontal, elongate rollers to hold the desired quilting materials. These rollers terminate in shafts, which are captured in grooves formed between the block and cap portions of a split side rail. The block and cap of these rails are fastened together by a plurality of adjustable clamping bolts, preferably one bolt adjacent each roller, so that pressure between the block and cap frictionally engages the roller shafts captured therebetween, and thus can be selected to lock or unlock the rollers within the rail. The rollers can thus be rolled and tightened to the desired degree of fore-and-aft tension by a lever or other means, and locked there to preserve the tension on the quilting materials. This split-rail bearing/brake rail system is superior to traditional tension systems in that it enables efficient, infinite adjustment of tension, and does not loosen under tension.

Also incorporated into this bearing/brake rail system is a lateral tension system comprising a small tension block conditioned for placement against the quilting material suspended between a given pair of rollers, with at least one tension cord extending laterally from the block through a groove in the rail block. The quilting material is connected (e.g., by pins) to the tension block via a short fabric leader, and the tension cord is pulled through the groove until the desired degree of lateral tension is achieved. This tension is maintained by tightening of a clamping screw or other fastening means down onto the tension cord. In the preferred embodiment, the tension cord is made of an elastic material, so that the lateral tension is more easily maintained after clamping. Thus, lateral tension of the quilting material can be achieved and adjusted, just as the fore-and-aft tension can be adjusted by the bearing/brake rail system described above.

Finally, the quilt frame of this invention includes a novel centering/alignment system on its rollers, enabling simple and precise placement of the quilting material (backing, batting, quilt top) onto the rollers to begin work. The centering/alignment system comprises a short segment of fabric leader attached to each roller, with the leader bearing a definitive center line indicia perpendicular to the roller axis. Thus, the user can mark the center line of the quilting material, and align that quilting material center line with the leader center line to insure proper centering. In addition, the leader is marked with a series of lines parallel to the roller axis, and perpendicular to the center line indicia. This enables the user to easily align the edge of the quilting material along one of these lines (assuming that the quilting material was cut squarely) to insure alignment of the quilting material on the roller, and alignment of the quilting material with the other quilting material similarly installed on the other rollers.

DETAILED DESCRIPTION OF A PREFERRED EMBODIMENT

Figure 1:
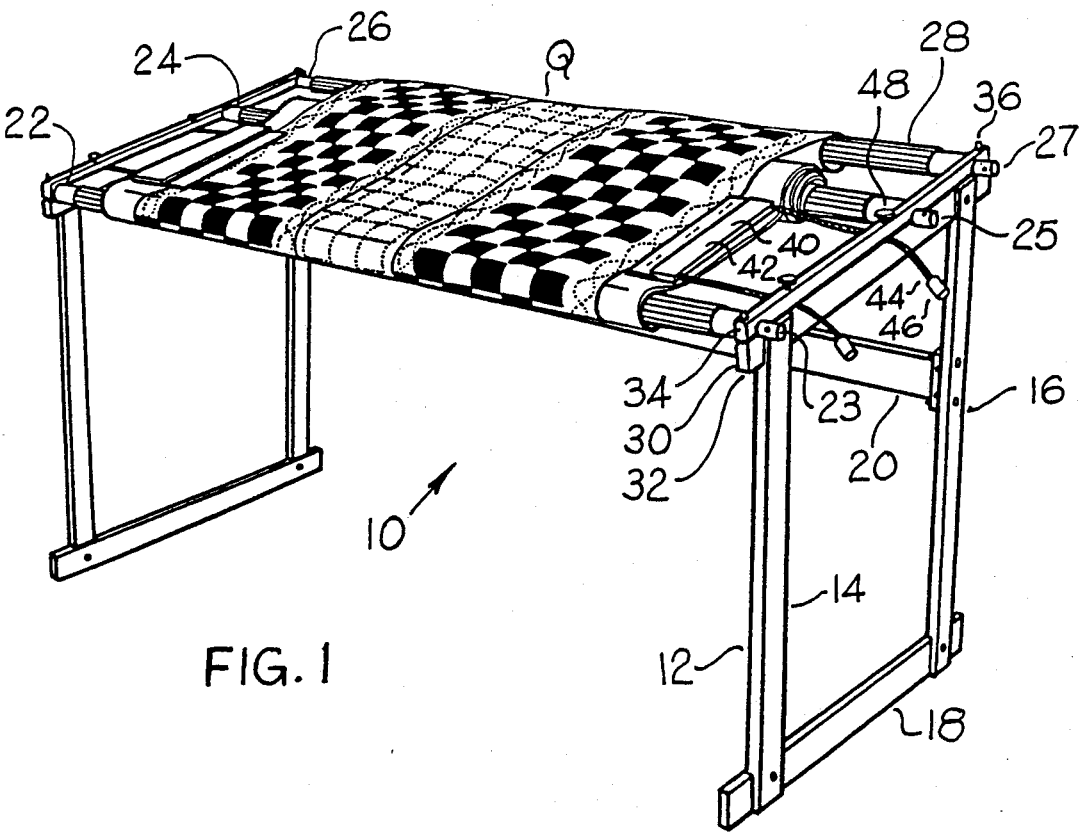
FIG. 1 is a perspective view of the quilt frame of this invention in use and with the quilting materials installed on the frame's rollers, illustrating the bearing/brake rail system and the lateral tension system in operation.

FIG. 1 is a perspective view of the quilt frame 10 of this invention in use and with quilting materials Q installed on the frame. Frame 10 includes support structure 12 comprising front legs 14, rear legs 16, foot rails 18, and cross rail 20. Suspended above these components are a series of elongate, generally horizontal rollers 22, 24, 26 each terminating at both ends in a relatively narrower shaft 23, 25, 27. Each of these rollers carries a short segment of fabric leader 28. These rollers are carried by and suspended between opposite sides of bearing/brake rail system 30. Each rail system 30 includes lower bearing/brake rail block 32 and upper bearing/brake rail cap 34, and are secured together by clamping bolts 36. Also visible in this view is the lateral tension system 40 comprising lateral tension block 42, tension cord 44, tension cord knob 46, and tension cord clamping screws 48.

Figure 2:
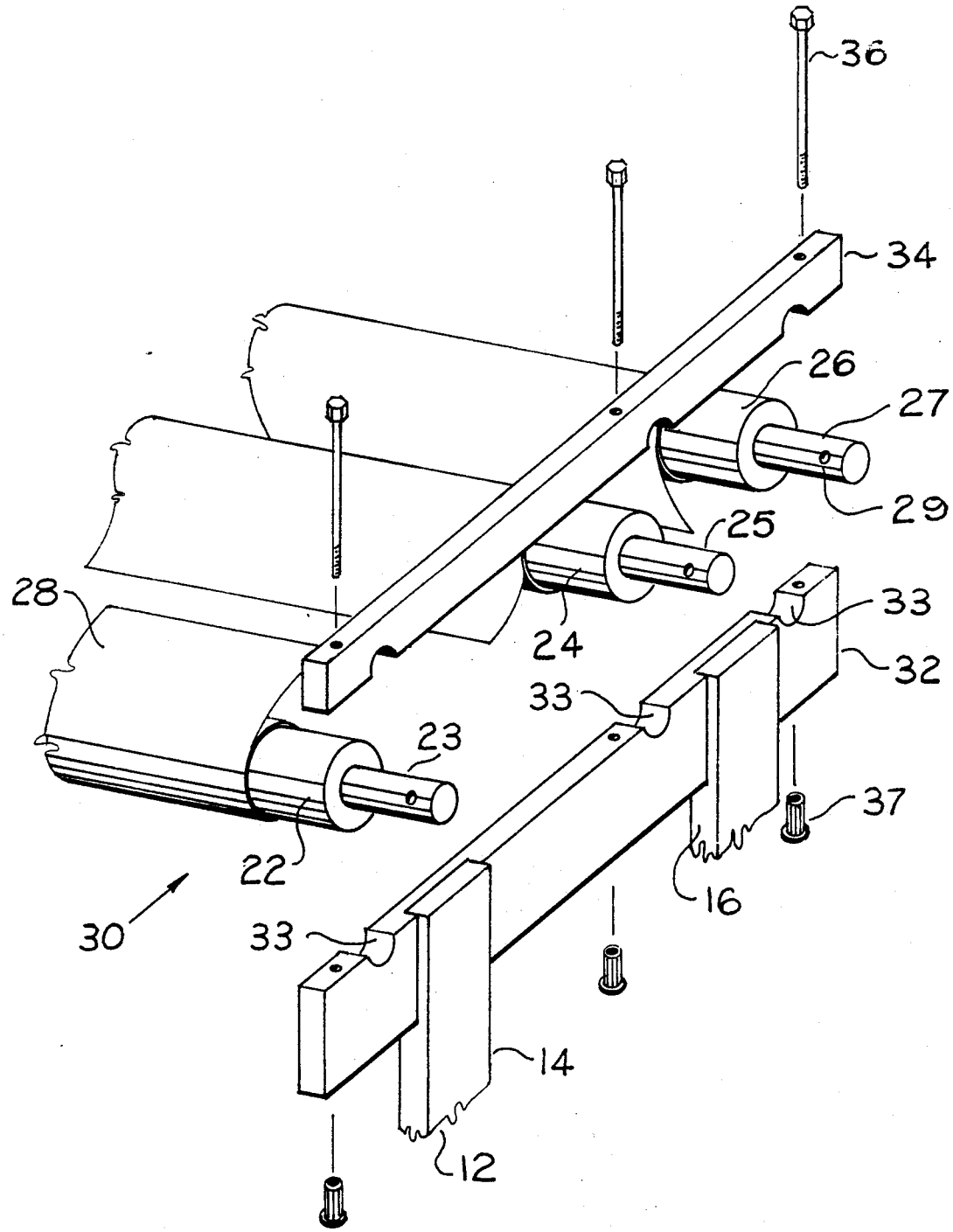
FIG. 2 is a cutaway exploded perspective view of the bearing/brake rail system of the quilt frame of this invention, illustrating the capture of the roller shafts between the block and cap portions of the rail.

FIG. 2 is a cutaway exploded perspective view of the bearing/brake rail system 30 of the quilt frame of this invention. Rail system 30 supports roller shafts 23, 25, 27 in roller grooves 33 formed in rail block 32 and rail cap 34. By appropriate tightening of clamping bolts 36 into captive nuts 37, the desired degree of pressure can be applied to these roller shafts. In use, the clamping bolts are loosened, the appropriate rollers moved by turning of the shaft (e.g., by insertion of a lever into shaft hole 29), and the clamping bolts are then tightened to secure this new position.

Figure 3:
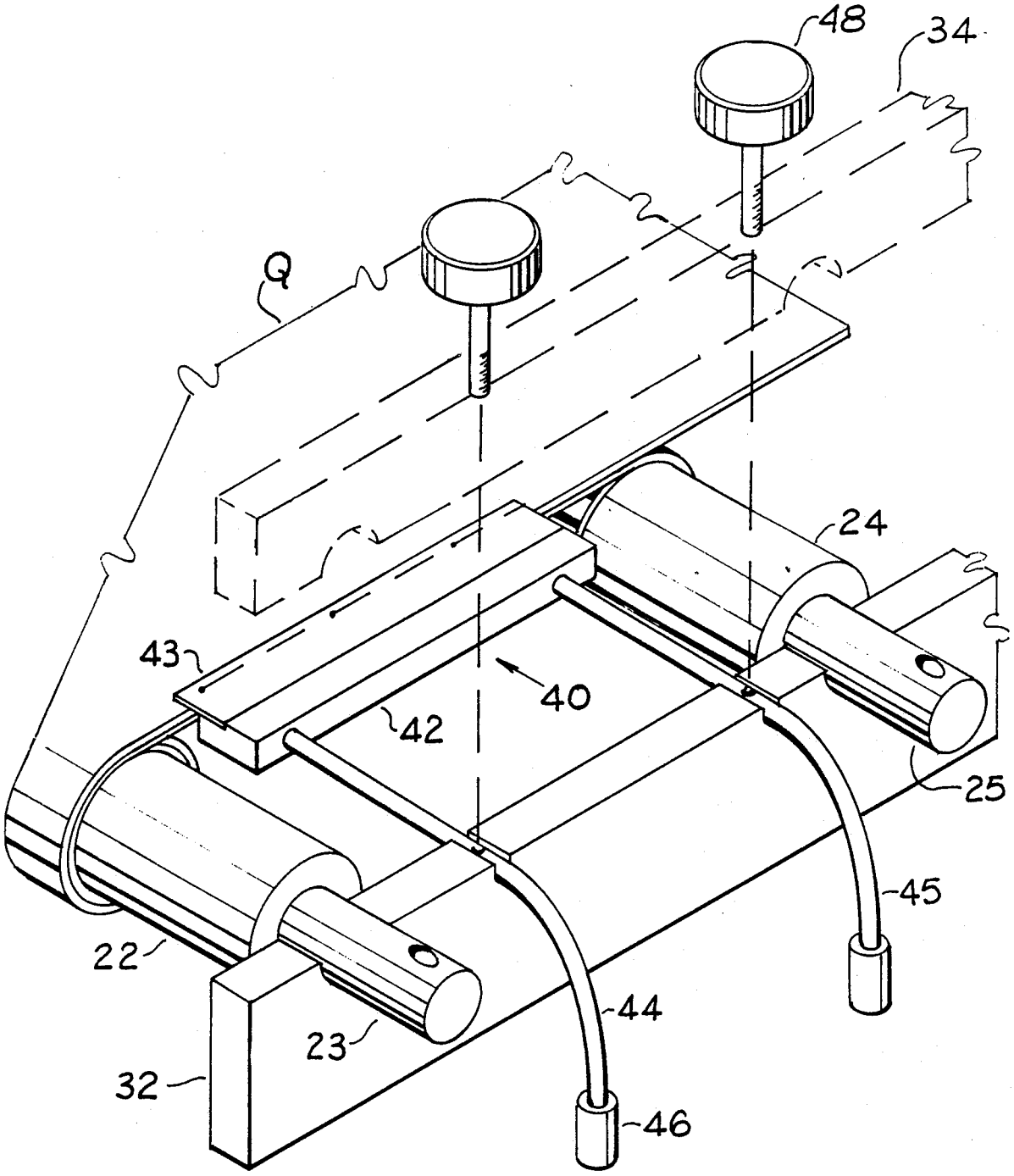
FIG. 3 is a cutaway exploded perspective view of the lateral tension system of the quilt frame of this invention, illustrating the attachment of the lateral tension block to the quilting material, and the capture of the lateral tension cords by the clamping screws.

FIG. 3 is a cutaway exploded perspective view of the lateral tension system 40 of the quilt frame of this invention, illustrating the attachment of the lateral tension block 42 to the quilting material Q via pins to tension block fabric leader 43. Tension cords 44 can then be pulled through grooves 45 between rail block 32 and rail cap 34 (shown in phantom), and clamping screws 48 tightened down upon the cords to secure their tightened position. Tension cords 44 are preferably made of an elastic material to enhance maintenance of the lateral tension after clamping.

Figure 4:
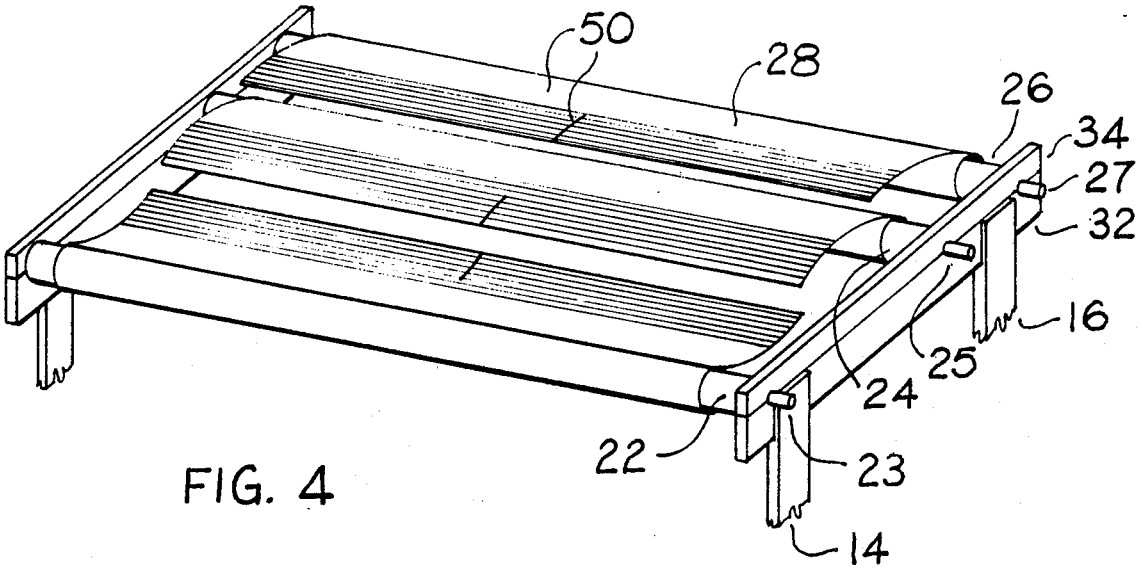
FIG. 4 is a cutaway perspective view of the roller leader quilting material alignment system of this invention, as installed on the three rollers of the quilt frame.

FIG. 4 is a cutaway perspective view of the roller leader quilting material alignment system 50 of this invention, as installed on the three rollers 22, 24, 26 of the quilt frame. This view illustrates that each roller bears a similar segment of fabric leader material 28. Indeed, the leaders of two adjacent rollers can be extended and pinned together to form a temporary sling for assistance in installing the quilting materials.

Figure 5:
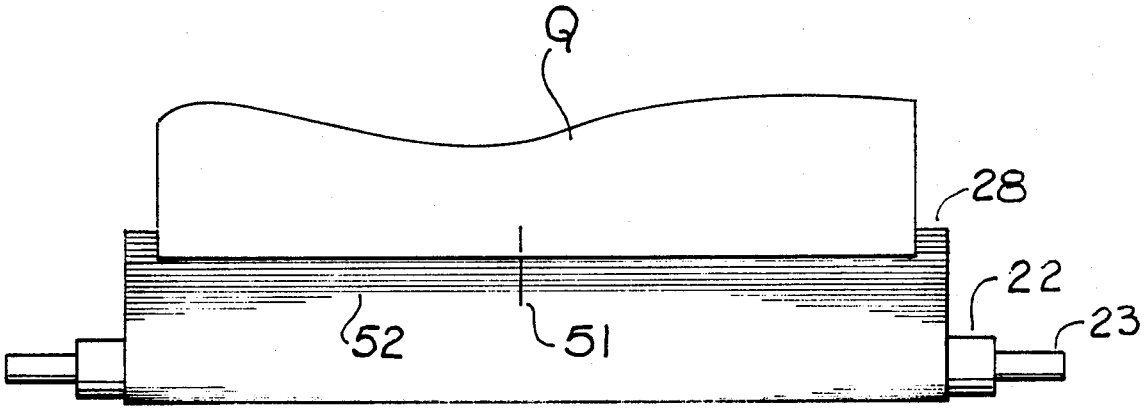
FIG. 5 is a cutaway top plan view of the roller leader fabric alignment system of one roller, as attached to a portion of quilting material.

FIG. 5 is a cutaway top plan view of the roller leader quilting material alignment system 50 of one roller 22, as attached to a portion of quilting material Q. Fabric leader 28 includes a clearly marked center line indicia 51 against which a center line marked on quilting material Q can be aligned to indicate proper centering of the quilting material. Leader 28 additionally includes a plurality of parallel stripes 52 perpendicular to indicia 51, adjacent which a squarely cut edge of quilting material Q can be placed, insuring proper alignment of the quilting material.

While this invention has been described in connection with preferred embodiments thereof, it is obvious that modifications and changes therein may be made by those skilled in the art to which it pertains without departing from the spirit and scope of the invention. Accordingly, the scope of this invention is to be limited only by the appended claims.

What is claimed as invention is:

1. A quilt frame having a support structure and at least two roller members for holding a length of quilting material, said roller members terminating in a shaft portion at each end, the improvement comprising:

a pair of tension block members located between said roller members and adjacent opposite sides of said quilting material to grip said material therebetween;

at least one tension cord member extendeing laterally from each of said tension block members;

a pair of rail members each including a rail block portion and a rail cap portion, each of said rail block and rail cap portions bearing complementary roller shaft grooves conditioned to capture said roller shafts, each of said rail members further including a tension cord groove conditioned to capture said tension cord member;

at least one clamping member adjustably connecting each of said rail block and rail cap portions; and fastening means comprising adjustable screws for securing said tension cord members against said tension cord grooves, whereby the lateral tension on said quilted material can be varied by changing the position of said cord on said rail members.

2. The quilt frame of claim 1 wherein said tension cord member is composed of elastic material.

3. The quilt frame of claim 1 wherein said roller members include a segment of leader material, said leader material having a center line, and said leader material bearing indicia indicative of said center line and the perpendicular to said center line.

* * * * *